US009930950B1

(12) United States Patent
Cage

(10) Patent No.: US 9,930,950 B1
(45) Date of Patent: Apr. 3, 2018

(54) DEVICE FOR DRYING

(71) Applicant: Kailyn Cage, Bowie, MD (US)

(72) Inventor: Kailyn Cage, Bowie, MD (US)

( * ) Notice: Subject to any disclaimer, the term of this patent is extended or adjusted under 35 U.S.C. 154(b) by 0 days.

(21) Appl. No.: 15/058,240

(22) Filed: Mar. 2, 2016

Related U.S. Application Data

(60) Provisional application No. 62/126,774, filed on Mar. 2, 2015.

(51) Int. Cl.
*A45D 20/12* (2006.01)

(52) U.S. Cl.
CPC ..... *A45D 20/12* (2013.01)

(58) Field of Classification Search
CPC ..... A45D 20/12; F26B 19/00; F26B 25/00; F26B 25/18
USPC ..... 34/553, 97, 90; 132/228; 392/384, 385
See application file for complete search history.

(56) References Cited

U.S. PATENT DOCUMENTS 1,508,735 A * 9/1924 Weiss ..... A45D 20/10 338/58
1,998,159 A * 4/1935 Johnson ..... A45D 20/44 34/100
2,479,387 A * 8/1949 Matthews ..... A45D 20/44 34/562
3,264,750 A * 8/1966 Berenbaum ..... G06F 58/04 34/546
3,460,524 A * 8/1969 Lazaridis ..... H01J 45/00 122/23
3,471,067 A * 10/1969 Stewart ..... D06F 71/08 223/57
3,766,844 A * 10/1973 Donnelly ..... F24F 3/1603 135/116
4,268,248 A * 5/1981 Wilbur ..... F02N 19/02 123/142.5 R
4,530,167 A * 7/1985 Hotovy ..... A23B 9/08 34/233
5,331,991 A * 7/1994 Nilsson ..... A62B 13/00 135/91
5,930,915 A * 8/1999 Dhaemers ..... A43D 3/1491 34/202
6,195,906 B1 * 3/2001 Stoll ..... F26B 11/028 34/80

(Continued)

FOREIGN PATENT DOCUMENTS

GB 512861 A * 9/1939 ..... F23D 14/00
GB 2038168 A * 7/1980 ..... A47L 7/0019
JP 08327081 A * 12/1996

*Primary Examiner* — Stephen M Gravini
(74) *Attorney, Agent, or Firm* — Fish & Richardson P.C.

(57) ABSTRACT

A device comprises a fan, a motor configured to operate the fan for moving air, a heating coil configured to heat air moved based on operation of the fan, a first arm, a second arm and a coupler. The first arm is configured to move air through the first arm based on operation of the fan. The second arm is configured to receive air moved through the first arm, heat received air using the heating coil, and expel heated air through an outflow opening of the second arm. The coupler couples the first arm to the second arm. The coupler is configured to orient the second arm in one of multiple positions relative to the first arm, and also configured to receive air from the first arm and transfer received air to the second arm through inflow and outflow openings respectively associated with the coupler.

26 Claims, 9 Drawing Sheets

(56) References Cited

U.S. PATENT DOCUMENTS

| | | | | |
|---|---|---|---|---|
| 6,938,886 | B2 * | 9/2005 | Glucksman | F22B 1/284 261/129 |
| 7,526,876 | B2 * | 5/2009 | Carey | A47L 23/205 34/103 |
| 7,997,004 | B1 * | 8/2011 | Adrian | E04H 15/12 126/109 |
| 8,235,776 | B2 * | 8/2012 | Stanimirovic | F24F 11/0086 454/254 |
| 8,707,577 | B2 * | 4/2014 | Lee | A45D 20/12 132/212 |
| 2016/0186421 | A1 * | 6/2016 | Lammel | E03D 9/08 4/420.5 |

* cited by examiner

DEVICE FOR DRYING

CROSS-REFERENCE TO RELATED APPLICATION

This application claims the benefit of U.S. Provisional Application No. 62/126,774, filed Mar. 2, 2015, and titled "DEVICE FOR DRYING," which is incorporated by reference.

TECHNICAL FIELD

This disclosure relates generally to an electrical device for drying.

BACKGROUND

An electrical device that blows air may be used for drying items, such as human hair, among others. Sometimes such a device may be a handheld electrical device.

SUMMARY

A drying device that is designed with an emphasis on ergonomics and configured to enable a user to use the device for drying target items or areas independently without assistance. The drying device facilitates a neutral handgrip for the user and reduces long moment arms. In some implementations, the drying device is a handheld hair dryer (also referred to as a blow dryer) that the user utilizes for drying his or her own hair.

In a general aspect, a device comprises a fan, a motor that is configured to operate the fan for moving air, a heating coil that is configured to heat air moved based on operation of the fan, a first arm, a second arm and a coupler. The first arm includes a first cavity enclosed by at least a wall of the first arm and is configured to move air through the first arm based on operation of the fan.

The second arm includes a second cavity enclosed by at least a wall of the second arm and an outflow opening to an external environment. The second arm is configured to receive air moved through the first arm, heat received air using the heating coil, and expel heated air through the outflow opening of the second arm.

The coupler couples the first arm to the second arm. The coupler is configured to orient the second arm in one of multiple positions relative to the first arm. The coupler is also configured to receive air from the first arm through an inflow opening associated with the coupler, and transfer received air to the second arm through an outflow opening associated with the coupler.

Particular implementations may include one or more of the following features. The device may include an airflow tube included in the first arm. The airflow tube may be configured to receive air moved by the fan through a first opening of the airflow tube, and increase at least one of air speed or air pressure by outputting air through a restricted second opening of the airflow tube that is smaller than the first opening of the airflow tube. The device may further include a second fan included in the coupler. The second fan may be configured to move air, received from the first arm via the second opening of the airflow tube, to the second arm with increased force. The inflow opening of the coupler may be aligned with the second opening of the airflow tube, the alignment configured to enable air outputted by the airflow tube to be received in the coupler for transferring to the second arm.

The coupler may comprise a first spherical frame that is coupled to the first arm and a second spherical frame that envelops the first spherical frame and is coupled to the second arm. The first spherical frame may include the inflow opening associated with the coupler that may be configured to enable alignment with an outflow opening of the first arm to receive air from the first arm into the first spherical frame. The first spherical frame may further include one or more additional openings.

The second spherical frame may include the outflow opening associated with the coupler that may be configured to enable alignment with an inflow opening of the second arm to transfer air received from the first arm to the second arm. The second spherical frame may further include a second opening that is configured to enable alignment with one of the additional openings of the first spherical frame to receive air from the first spherical frame.

At least one of the first spherical frame or the second spherical frame may be maneuverable with respect to each other to enable alignment of the second opening of the second spherical frame with one of the additional openings of the first spherical frame. Remaining openings of the first spherical frame may be blocked when the second opening of the second spherical frame is aligned with one of the additional openings of the first spherical frame.

The device may include a processing module and a temperature sensor. The temperature sensor may be configured to determine a temperature of heated air and communicate the temperature of heated air to the processing module.

The processing module may be configured to compare the temperature of heated air to a preconfigured threshold and execute instructions to automatically reduce amount of heat generated by the heating coil when the temperature of heated air exceeds the preconfigured threshold. The processing module may be configured to execute instructions to automatically switch operation of the device from generating heated air to generating unheated air. The temperature sensor may be affixed to a wall of the second arm and may be configured to determine a temperature of heated air that is expelled through the opening of the second arm.

The device may include a control panel, which may be configured to present, using a user interface, options to enable a user to adjust one or more settings associated with operation of the device. The one or more settings may include at least one of air pressure, temperature of heated air, or operational time of the device.

The device may include a display associated with the control panel. The control panel may be configured to present the user interface as a graphical user interface shown on the display.

The second arm may be configured to be replaceable with a different second arm having a different shape. At least one of the motor, the fan, or the heating coil may be positioned within the first cavity of the first arm. At least one of the motor, the fan, or the heating coil may be positioned within the second cavity of the second arm. At least one of the motor, the fan, or the heating coil may positioned within the coupler.

The motor may include one or more of ceramic magnets, copper coil, a battery, or a rod with leads attached to the battery. The motor may be covered by a casing.

In another general aspect, a device comprises a fan, a first arm, a second arm and a coupler. The first arm includes a first cavity enclosed by at least one wall of the first arm. The first arm also includes a motor positioned within the first cavity. The motor is configured to operate the fan to move air through the first arm.

The second arm includes an outflow opening to an external environment and a heating coil positioned within a second cavity enclosed by at least one wall of the second arm. The second arm is configured to receive air moved through the first arm, heat received air using the heating coil and expel heated air through the outflow opening. The coupler couples the first arm to the second arm.

The coupler is configured to maneuver the second arm relative to the first arm. The coupler is also configured to receive air from the first arm through an inflow opening associated with the coupler and transfer received air to the second arm through an outflow opening associated with the coupler.

Particular implementations may include one or more of the following features. The coupler may include a first frame that is coupled to the first arm. The first frame may include the inflow opening associated with the coupler that may be configured to enable alignment with an outflow opening of the first arm to receive air from the first arm into the first frame. The first frame may further include one or more additional openings.

The coupler may include a second frame that envelops the first frame and is coupled to the second arm. The second frame may include the outflow opening associated with the coupler that may be configured to enable alignment with an inflow opening of the second arm to transfer air received from the first arm to the second arm. The second frame may further include a second opening that may be configured to enable alignment with one of the additional openings of the first frame to receive air from the first frame.

At least one of the first frame or the second frame may be configured to be maneuverable with respect to each other to enable alignment of the second opening of the second frame with one of the additional openings of the first frame.

The device may include an airflow tube included in the first arm. The airflow tube may be configured to receive air moved by the fan through a first opening of the airflow tube, and increase at least one of air speed or air pressure by outputting air through a restricted second opening of the airflow tube that is smaller than the first opening of the airflow tube.

The device may include a processing module and a temperature sensor. The temperature sensor may be configured to determine a temperature of heated air and communicate the temperature of heated air to the processing module. The processing module may be configured to compare the temperature of heated air to a preconfigured threshold and execute instructions to automatically reduce amount of heat generated by the heating coil when the temperature of heated air exceeds the preconfigured threshold.

The device may include a control panel. The control panel may be configured to present, using a user interface, options to enable a user to adjust one or more settings associated with operation of the device.

The details of one or more disclosed implementations are set forth in the accompanying drawings and the description below. Other features, aspects, and advantages will become apparent from the description, the drawings and the claims.

BRIEF DESCRIPTION OF THE DRAWINGS

Like reference symbols in different figures indicate like elements.

DETAILED DESCRIPTION

Figure 1A:
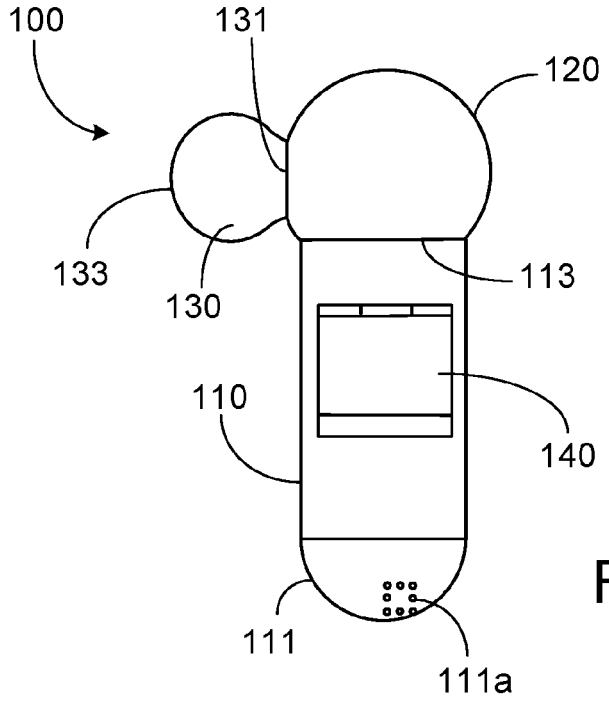
FIGS. 1A and 1B illustrate two views of an example of a drying device designed for personal use.

Typical handheld drying devices are designed for a person to use in drying items or target areas that are not on the person's body. For example, traditional handheld hair dryers are designed for ease of use by hair stylists for drying hairs of other people. When a user attempts to use a traditional handheld hair dryer for drying his or her own hair, the user may be forced to adopt postures that involve awkward positioning of the user's upper limbs, which may cause discomfort to the user. For example, a posture may cause large moments on the neck (e.g., extended and flexed neck postures); large angles of shoulder abduction; non-neutral wrist postures, including wrist flexion or wrist extension; ulnar and radial deviation; supination and flexion postures of the arm; or any suitable combination of these. Due to the adoption of such uncomfortable postures, it may take longer for the user to dry hair using the traditional hair dryer, or the drying operation may not be effective, or both. In this context, a neutral wrist position or posture, or a neutral handgrip, refers to a positioning of the wrist that is straight, i.e., without any bend (e.g., wrist extension or flexion) or deviation (either ulnar or radial), with respect to the forearm.

Additionally or alternatively, traditional hair dryers may not include options to allow the user to adjust settings for heat that is generated by the hair dryer. Consequently, the user may have to use the hair dryer using a higher heat setting than the user desires. In some cases, the higher heat setting may cause heat damage to the user's hair, particularly when used for extended periods (which may be the case due to the adoption of uncomfortable postures).

Accordingly, it may be useful to design a drying device, such as a handheld hair dryer, with an emphasis on ergonomic principles that minimize awkward postures of a user when the user operates the device for drying targeted areas or items, such as hair, on his or her person. It also may be useful to include options in the device for adjusting settings for the heat generated by the device, such that users are enabled to customize the application of heat as individually desired.

The following sections describe a drying device designed with an emphasis on ergonomics for personal use, where a user engages the device in performing an action independently without assistance. The drying device may be used by both left-handed and right-handed users due to the device's ambidextrous design approach. The device can be configured in multiple orientations, thereby enabling a user to use the device effectively for targeted treatment while maintaining postures that are comfortable. The device may also include customizable heat settings and may be useful to users who seek a hair dryer that can be adapted for their hair texture and strand thickness. The device may be used for drying hair faster, and may reduce heat damage by drying for the texture and thickness of hair. In some implementations, temperature sensors located in the nozzle of the drying device assist in limiting the concentration of heat to targeted treatment areas, such as specific areas of the user's hair.

Figure 1B:
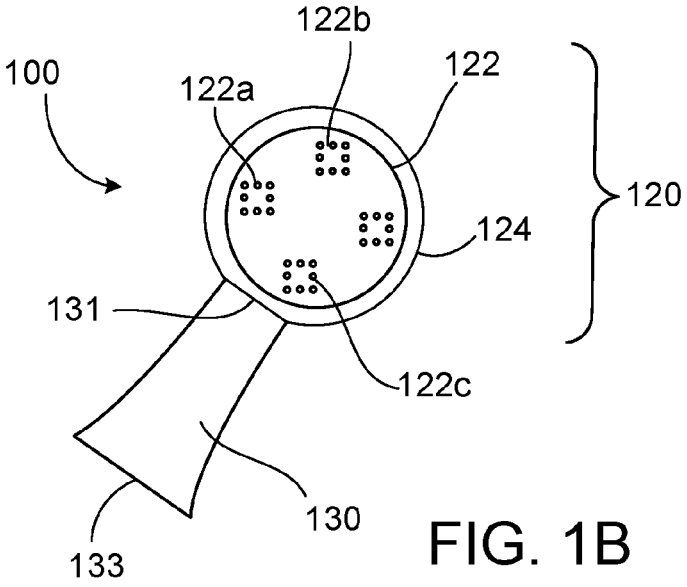

FIGS. 1A and 1B illustrate two views of an example of a drying device 100 designed for personal use. For example, the drying device 100 may be a handheld hair dryer or blow dryer that is ergonomically designed to enable a user to operate the device effectively while maintaining postures that are comfortable to the user.

FIG. 1A displays a first view of the drying device 100. The drying device 100 includes a first arm 110, a second arm 130 and a rotatable coupler 120 that couples the first arm 110 to the second arm 130. Included in the first arm 110 is a control panel 140.

In some implementations, the first arm 110 may be a handle for the drying device 100. A user may operate the drying device 100 by holding the device using the first arm 110. In some implementations, the first arm 110 includes a central cavity enclosed by walls of the first arm. In some implementations, a motor is positioned within the central cavity of the first arm 110. However, in some other implementations, the motor is positioned within the rotatable coupler 120, as described below. In some implementations, a fan is also positioned within the central cavity of the first arm 110. In some implementations, a fan is placed inside the rotatable coupler 120, which may be in addition or as an alternative to the fan in the first arm 110. When electricity is applied to the device 100, the motor is configured to operate the fan for blowing air that is applied to the target area or item to be dried, as described in greater detail in the following sections. In some implementations, the fan may be in the shape of a fin.

Electricity may be applied to the device 100 by connecting the device to an electrical outlet using a wired connection. Alternatively, a portable energy source, such as a battery pack, may be used to apply electricity to the device 100, which allows the device 100 to be used wirelessly. In some implementations, the battery pack may be included in the device 100. The battery pack may be included in the first arm 110, in the second arm 130, or in the rotatable coupler 120.

As shown in FIG. 1A, one end 113 of the first arm 110, also referred to as an outflow end 113, is coupled to the rotatable coupler 120. In some implementations, the other end 111, also referred to as an inflow end 111, of the first arm 110 includes one or more perforations or holes 111*a* that are open to the external environment. In some implementations, the inflow end 111 is entirely open to the external environment. In such implementations, the inflow end 111 may be covered by a grill. During operation of the motor and the fan, air is drawn in through these perforations or holes 111*a*, and moved through the first arm 110 toward the rotatable coupler 120 by the operation of the motor and the fan.

In some implementations, in addition to the motor and the fan, the first arm 110 includes other components that force the air with increased pressure and/or speed toward the rotatable coupler. Such components include, among others, an airflow tube, which is described in greater detail in the following sections.

As shown in FIG. 1A, the first arm 110 includes a control panel 140. The control panel 140 provides one or more options to the user to operate the drying device 100. These may include options to adjust settings for the device. In some implementations, the settings include amount of heat generated by the device to heat the air that is blown through the device for application to the target treatment area or item. For example, settings may allow the user to set the maximum and/or minimum heat of the air that is blown by the drying device. Additional settings may include settings for the pressure, or speed, or both, of the air that is applied to the target area or item; an amount of time the device is to remain operational during use; or options to automatically adjust the generated heat, the pressure, or the speed of the air. In this context, automatic adjustment refers to adjustment without human intervention, e.g., based on automatic execution of processing logic by one or more processors associated with the drying device, as described in greater detail in the following sections.

In some implementations, the control panel 140 includes an electronic display. The display may be covered by a suitable transparent protective material, e.g., glass or some non-breakable material. The electronic display may be a touchscreen display. The user may interact with a graphical user interface (GUI) shown on the touchscreen display to adjust the settings of the device. In addition or as an alternative to the touchscreen, the control panel 140 may include one or more physical buttons that are to be depressed by the user to adjust the settings for the device.

In some implementations, the control panel 140 may provide other features that use the electronic display, for example showing information on the electronic display about the current operation of the device, or the percentage of battery charge remaining.

The operation of the drying device 100 may be controlled by processing logic that is programmed in the device. The processing logic may be implemented as instructions stored in hardware memory included in the device, e.g., as firmware. The drying device 100 may include one or more processors or microcontrollers for executing the instructions to operate the device, which may include operating the motor, fan and generation of heat; providing options and information to the user via the control panel 140; processing user inputs received via the control panel 140 and adjusting the settings of the device based on these user inputs.

In some implementations, the control panel 140 may be used to show, e.g., via the electronic display, information about the firmware, such as the firmware version. Other information about the drying device 100 also may be shown, e.g., the model number and/or serial number of the device, the date of manufacture, diagnostic information regarding any unusual conditions encountered during operation of the device (e.g., device malfunction, such as overheating, fan not operating properly, etc.), among others.

The second arm 130 is coupled to the rotatable coupler 120 at one end 131 (also referred to as an inflow end 131), while the opposite end 133 (also referred to as an outflow end 133) of the second arm 130 is open to the external environment. In some implementations, the second arm 130 may be a nozzle for the drying device 100. The nozzle may be approximately conical in shape, with the circular inflow end 131 having a smaller diameter than the circular outflow end 133, such that the nozzle has a "flaring" shape at its outlet. However, in other implementations, the nozzle may have a different shape. In some implementations, the outflow end 133 of the second arm may have a dimension (e.g., the diameter of the outflow opening) such that a large target area may be covered during application of air blown by the drying device 100.

The second arm 130 is configured to receive, via the rotatable coupler 120, the air that is blown through the first arm 110. In some implementations, the second arm 130 includes one or more heating components to heat the air and expel the heated air to the external environment through the opening at the outflow end 133, such that the heated air may be applied to the target area or item. For example, the second arm 130 may include one or more heating coils that are positioned with a central cavity of the second arm 130, which is described in greater detail in the following sections. However, in other implementations, the heating components may be placed, additionally or alternatively, in the first arm 110, or in the rotatable coupler 120, or both. In such implementations, the second arm 130 is configured to receive heated air from the rotatable coupler 120. The heating components are positioned such that the heating components receive air that is blow by one or more fans included in the drying device 100.

In some implementations, the second arm 130 includes a temperature sensor, or multiple temperature sensors, as described in greater detail below. The temperature sensor (or multiple sensors, as the case may be) may be affixed to an inner wall of the second arm 130 that surrounds the central cavity of the second arm. In some implementations, the temperature sensor may be positioned proximate to the outflow end 133 and configured to measure the temperature of the heated air as it is expelled to the external environment through the opening at the outflow end 133. However, in some implementations, the sensor may be positioned elsewhere in the second arm 130, or positioned in the rotatable coupler 120, or the first arm 110. The latter may be the case, for example, when the air is heated using heating components in the rotatable coupler 120, or the first arm 110, respectively.

In some implementations, the temperature sensor, or the heating components, or both, may be communicatively coupled to the microcontroller and the firmware included in the drying device 100. For example, the temperature sensor and/or the heating components may be coupled to the microcontroller and the firmware using electrical wiring embedded in the inner walls of the first arm 110, the second arm 130 and/or the rotatable coupler 120. Alternatively, the temperature sensor and/or the heating components may be wirelessly connected to the microcontroller and the firmware.

Data collected by the temperature sensor may be transmitted to the microcontroller. Upon processing the data, the microcontroller may execute firmware logic to adjust the settings for the amount of heat that is applied to the air, and/or the speed/pressure of the air. The microcontroller may compute the amount of heat based on the temperature of the heated air (as measured by the temperature sensor), or the time duration for which the air is applied (as measured by the microcontroller and/or the sensor), or both. In some implementations, the microcontroller may compare the amount of heat to one or more threshold values. If the computed amount of heat exceeds a threshold value, in some implementations the microcontroller may execute instructions to reduce the amount of heat that is applied to the air. For example, the microcontroller may control the heating component(s) to reduce the amount of heat generated by the heating component(s). In some implementations, the threshold values may be configured by a user, e.g., by entering values for desired amount of heat, or selecting from various heating options, through the control panel.

In some implementations, if the computed amount of heat exceeds a threshold value, the microcontroller may execute instructions to generate an alert that is configured to warn the user of excessive heat application. The alert may be, e.g., an audible alert (such as a beep), or a visual alert (such as a warning message shown on a display of the control panel 124). The generated alert may be in addition, or as an alternative to, executing instructions for controlling the heating component(s) to reduce the amount of heat that is generated.

In some implementations, the logic may allow the drying device to shift automatically from a heating mode to a cooling mode. This may be useful, for example, for users who use heat for treating a portion of the target area (e.g., roots of the hair), but use cooler air for treating other portions of the target area (e.g., ends of the hair).

The rotatable coupler 120 (also referred to as rotatable joint) is coupled to the first arm 110 and the second arm 130, as described above. In some implementations, the rotatable coupler 120 may have a spherical shape. However, in other implementations the rotatable coupler 120 may have some other suitable shape, such as a spheroid, ovoid, ellipsoid, or cube, among others.

FIG. 1B shows a second view of the drying device 100, illustrating a view of the rotatable coupler 120 and the second arm 130 taken from above along a vertical axis corresponding to the first arm 110. As shown by FIG. 1B, in some implementations the rotatable coupler 120 includes two or more concentric spheres 122 and 124 (or some other appropriate shape, as the case may be). The following sections describe an implementation of the rotatable coupler 120 with two concentric spheres.

The inner sphere 122 is also referred to as an air pocket. The air pocket 122 is coupled to the first arm 110 at the outflow end 113 of the first arm. The coupling of the air pocket 122 to the first arm 110 is achieved such that an opening or hole, e.g., 122*a*, on the surface of the air pocket 122 is aligned with an opening at the outflow end 113 of the first arm. This configuration enables air that is blown through the first arm 110 to enter a central cavity enclosed by a solid surface of the air pocket 122. One or more additional openings or holes, e.g., 122*b* and/or 122*c*, are included on the surface of the air pocket 122.

The outer sphere 124 is also referred to as a pocket frame 124, which is concentric with the air pocket 122 and envelops the air pocket 122. The pocket frame 124 is coupled to the second arm 130 at the inflow end 131 of the second arm. The pocket frame 124 includes a first opening on the surface of the pocket frame that is aligned with an opening at the inflow end 131 of the second arm, as described in greater detail below. The pocket frame 124 includes a second opening on the surface of the pocket frame through which the first arm 110 is partially inserted to couple to the air pocket 122 that is enclosed within the pocket frame. In some implementations, the second opening of the pocket frame 124 may have a suitable dimension to allow the pocket frame to rotate relative to the air pocket 122 in multiple orientations, as described below, without being impeded by the coupling of the first arm 110 to the air pocket 122.

The air pocket 122 or the pocket frame 124, or both, are configured such that a user may rotate the air pocket and/or the pocket frame in different directions. In some implementations, when the pocket frame 124 is rotated such that the first opening of the pocket frame 124 is aligned with one of the additional openings (e.g., 122*b* and/or 122*c*) of the air pocket 122, then the air that enters the air pocket 122 from the first arm 110 is blown through the first opening of the pocket frame 124 and into the second arm 130. In some implementations, the alignment of the first opening of the pocket frame 124 with one of the additional openings (e.g.,

122*b* and/or 122*c*) of the air pocket 122 is achieved by rotating the air pocket 122. In some implementations, both the air pocket 122 and the pocket frame 124 are rotated to achieve above alignment. In this manner, by rotating the air pocket 122 and/or the pocket frame 124 to be in different positions such that the first opening of the pocket frame is aligned with a different opening of the air pocket 122 in each position, air may be blown through the second arm 130 while enabling the drying device 100 to have multiple orientation capabilities.

In some implementations, the coupling of the pocket frame 124 to the air pocket 122 forms a structure analogous to a ball-and-socket joint that allows multidirectional movement and rotation. In some implementations, the coupling of the pocket frame 124 to the air pocket 122 is configured to enable the pocket frame 124 to rotate in two dimensions relative to the air pocket, while in some implementations the coupling is configured to enable the pocket frame 124 to rotate in three dimensions relative to the air pocket 122.

In some implementations, the motor is placed in the ball, i.e., the air pocket 122, of the ball-and-socket configuration. This may be done, for example, for center or mass considerations. In such implementations, air circulation and rotation occurs inside the air pocket 122, which may be altered to allow for 180-degree y-x-axis rotation and 360-degree x-axis rotation for the air pocket 122 and pocket frame 124 ball-and-socket configuration.

In some implementations, the air pocket 122 may be removed from the pocket frame 124. This may be the case, for example, in implementations where the motor and/or the heating mechanism are included in the air pocket 122. By removing the air pocket 122, it may be made available for handheld use, for example with an additional attachment or shield that protects the user against heat generated by the motor.

In some implementations, the pocket frame 124 is tightly coupled to the air pocket 122, with an inner surface of the pocket frame 124 in physical contact with an outer surface of the air pocket 122. In such implementations, the inner surface of the pocket frame 124, or the outer surface of the air pocket 122, or both, are configured to be smooth so as to enable the pocket frame 124 to be rotated without friction or resistance with respect to the air pocket 122.

In some implementations, the pocket frame 124 is coupled to the air pocket 122 such that an inner surface of the pocket frame 124 is physically separated from an outer surface of the air pocket 122. In such implementations, a suitable material or structure that enables the pocket frame 124 to be rotated without friction or resistance with respect to the air pocket 122 is present in the space between the outer surface of the air pocket 122 and the inner surface of the pocket frame 124. For example, a suitable material may be a colloid, such as a gel, or a viscous liquid, such as an oil. Alternatively, a suitable structure may include ball bearings. In some implementations, a combination of a suitable material, e.g., a colloid, and a suitable structure, e.g., a ball bearing, may be used.

The presence of the material and/or the structure is configured to maintain the pocket frame 124 in position with respect to the air pocket 122. In some implementations, the material may be non-permeable, e.g., to prevent air from escaping into the space between the air pocket 122 and the pocket frame 124.

Figure 2:
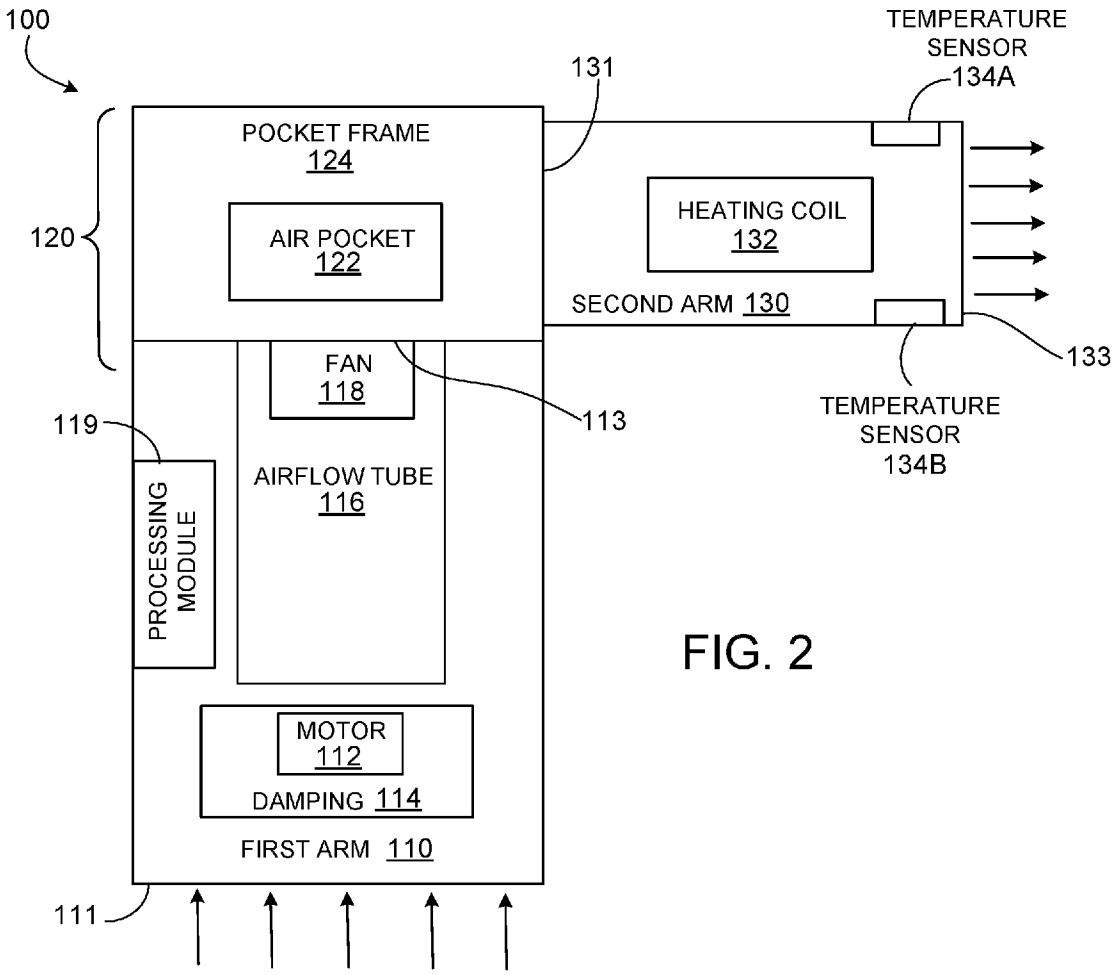
FIG. 2 illustrates a block diagram of an example of the drying device.

FIG. 2 illustrates a block diagram of an example of the drying device 100. The drying device 100 shown in FIG. 2 includes a first arm 110, a rotatable coupler 120 and a second arm 130. As shown, the first arm 110 includes a motor 112 and damping 114. The first arm 110 also includes an airflow tube 116, a fan 118 and processing module 119. The rotatable coupler 120 includes an air pocket 122 and a pocket frame 124. The second arm 130 includes a heating coil 132 and temperature sensors 134*a* and 134*b*.

In some implementations, the first arm 110 can be a handheld enclosure, as described previously. A user may maneuver the drying device 100 during operation by holding the first arm 110. The motor 112 is configured to move the fan 118 when electricity is applied to the motor 112. In some implementations, damping 114 is coupled to the motor 112 to reduce the sound, vibrations, or both, which are generated during operation of the motor 112. The damping 114 may be a suitable material that is configured to absorb the sound waves, or the pressure waves, or both, associated with the operation of the motor 112.

The placement of the motor 112 in the first arm 110 may facilitate maintaining a weight neutrality of the drying device 100. This may be the case, for example, when a user operates the drying device 100 by holding the first arm 110. In such cases, including the motor 112 in the first arm 110 enables the user to handle the weight of the drying device with greater ease, thereby leading to a more comfortable use. However, in some implementations the motor 112 may be placed elsewhere. For example, in some implementations, the motor 112 may be included in the rotatable coupler 120, or in the second arm 130.

The fan 118 may be electrically coupled to the motor 112, such that the fan is operated when electricity is applied to the motor 112. During operation, the blades of the fan rotate to draw in air from the external environment through the inflow opening of the first arm 110 (e.g., the openings at the inflow end 111, as described above), and move the air into the rotatable coupler 120.

In some implementations, the air is moved through the airflow tube 116. The airflow tube is configured to provide a restricted passage for the movement of air through the first arm 110, such that the air is exited into the rotatable coupler 120 with increased pressure, or speed, or both. This may be useful in implementations where the size, or placement, or both, of the motor 112 are such that the motor generates limited pressure and/or speed of the air. In such cases, the airflow tube may augment the speed and/or pressure of the air as it exits the first arm 110. In some implementations, the airflow tube 116 may not be present. In such implementations, the air is moved through the entire central cavity of the first arm 110.

FIG. 2 indicates that the fan 118 is positioned within the airflow tube 116. However, in some implementations, the position of the fan 118 may be different from that shown in FIG. 2. For example, the fan 118 may be located outside the airflow tube 116, or the airflow tube 116 may not be present, as noted above. In some implementations, the fan 118 may be placed in close proximity to the motor and physically coupled to the motor. In some implementations, the fan may be located in the rotatable coupler 120 and coupled to the motor 112 through electrical connections.

The processing module 119 controls the operation of the drying device 100 following logic that is programmed into the processing module. As described previously, the processing module 119 may include hardware memory that stores processing logic implemented as instructions (e.g., firmware). The processing module 119 also may include one or more microcontrollers or processors for executing the instructions to operate the device, e.g., running the motor and fan; operating the heating coil 132 for generation of heat; providing options and information to the user via the control panel 140; processing user inputs received via the control panel 140 and adjusting the settings of the device based on these user inputs; receiving and processing data collected by the temperature sensors 134*a* and/or 134*b*; and adjusting the heat generation and/or on time of the device based on the processed data, among others.

Although FIG. 2 indicates that the processing module 119 is included in the first arm 110, in some implementations the processing module may be placed elsewhere. For example, in some implementations, the processing module 119 may be included in the rotatable coupler 120, or in the second arm 130.

The rotatable coupler 120 is coupled to the first arm 110 and the second arm 130, as described above. As described previously, the rotatable coupler 120 includes an air pocket 122 and a pocket frame 124. In some implementations, the air pocket 122 and the pocket frame 124 may be concentric spheres, with the diameter of the pocket frame 124 being larger than the diameter of the air pocket 122 such that the pocket frame 124 envelops the air pocket 122.

In some implementations, the air pocket 122 is coupled to the first arm 110 and the pocket frame is coupled to the second arm 130. The air pocket 122 includes several openings. The coupling of the air pocket 122 to the first arm 110 is achieved such that an opening of the air pocket 122 is aligned with an opening at the outflow end 113 of the first arm 110. This configuration enables air that is blown through the first arm 110 to enter a central cavity of the air pocket 122. The air pocket 122 includes one or more additional openings for allowing the air to exit the air pocket 122 when an opening of the pocket frame 124 is aligned with an additional opening of the air pocket.

In some implementations, a fan is located inside the air pocket 122. This fan is configured to add power to the funneled air from the airflow tube 116. In some implementations, the fan in the air pocket is in addition to the fan 118, while in other implementations, the fan in the air pocket replaces the fan 118.

In some implementations, the pocket frame 124 is coupled to the second arm 130, such that a first opening of the pocket frame 124 is aligned with an opening at the inflow end 131 of the second arm 130. The outflow end 133 of the second arm 130 is open to the external environment. In some implementations, the second arm 130 may be a nozzle for the drying device 100.

As noted previously, the air pocket 122 or the pocket frame 124, or both, are configured such that a user may rotate the air pocket and/or the pocket frame in different directions. By rotating the air pocket 122 and/or pocket frame 124 to be in different positions, the first opening of the pocket frame may be aligned with a different opening of the air pocket 122 in each position. When the first opening of the pocket frame 124 is aligned with a an opening of the air pocket 122 in a particular position, air that enters the air pocket 122 from the first arm 110 can be blown into the second arm 130 through aligned opening of the air pocket 122, the first opening of the pocket frame 124 and the inflow end opening of the second arm 130. The air is then expelled to the external environment through the opening at the outflow end 133 of the second arm 130. In this manner, the multi-direction rotary configuration of the air pocket 122 and the pocket frame 124 enables the drying device 100 to have multiple orientations for blowing air.

As described above, the second arm 130 is configured to receive, via the first opening of the pocket frame 124, the air that is blown from the first arm 110 and the air pocket 122. In some implementations, the heating coil 132 is configured to heat the air prior to expelling the air to the external environment through the outflow end 133 opening. In some implementations, more than one heating coil may be present. As described previously, in some implementations the heating coil(s) may be placed elsewhere in the second arm, or in the first arm 110 or rotatable coupler 120.

As shown in FIG. 2, the second arm 130 includes temperature sensors 134*a* and 134*b*. However, in some implementations, the second arm 130 may include one temperature sensor, or more than two temperature sensors. In some implementations, a temperature sensor may not be present in the second arm 130.

Describing the implementation with two temperature sensors as shown, the temperature sensors 134*a* and 134*b* are attached to an inner wall of the second arm 130. In some implementations, the temperature sensors 134*a* and/or 134*b* may be positioned in the second arm 130 proximate to the outflow end 133 opening, as shown in FIG. 2, and configured to measure the temperature of the heated air as it is expelled to the external environment through the outflow end 133 opening. However, in some implementations, one or both the sensors may be positioned elsewhere in the second arm 130, or in the rotatable coupler 120 or the first arm 110. The latter may be the case, for example, when the air is heated using heating components in the rotatable coupler 120 or the first arm 110 respectively.

In some implementations, the temperature sensors are communicatively coupled to processing module 119, as described previously. Data collected by the temperature sensors 134*a* and 134*b* may be transmitted to a microcontroller included in the processing module 119. Upon processing the data, in some implementations the microcontroller executes firmware instructions to adjust the settings for the amount of heat that is applied to the air, and/or the speed/pressure of the air. The microcontroller may compute the amount of heat based on the temperature of the heated air (as measured by the temperature sensor), or the time duration for which the air is applied (as measured by the microcontroller and/or the sensor), or both. The heating coil 132 also may be communicatively coupled to the microcontroller in the processing module 119 such that the amount of heat generated by the heating coil 132 is controlled based on adjustments made by the microcontroller.

Using a configuration of the drying device 100 as described in the preceding sections, air may be blown with suitable force through the drying device 100 using a small-sized motor. The small size of the motor may cause the drying device 100 to be lightweight, low-noise and steady to hold, i.e., without much vibrations during operation. The air may be heated to a suitable temperature as the air is applied to a target area. The temperature of the heated air may be automatically adjusted based on the temperature sensor readings of the heated air, the amount of time the device is operated at a time, or user input, or any suitable combination of these. The first arm 110 and/or the second arm 130 may be rotated relative to one another such that the drying device 100 can be used in one of several orientations. This may allow the user to use the device effectively while maintaining a neutral handgrip that is comfortable to the user. In some implementations, effective use of the device may include better grip and direction control while operating the device. In some implementations, the first arm 110 includes rest points for the user's palm and fingers to provide further comfort to the user.

The drying device 100 also may provide easy-to-use options to adjust the settings of the device, or display device information, or both, using a user-friendly control panel 140, which may include an easy-to-view display. In some implementations, the display may show enlarged icons in the GUI. This may be useful, for example, to enable users with limited eyesight capabilities to view the settings and/or other information about the device.

In some implementations, lighter materials are used in the construction of the drying device, which may lead to an overall reduction in weight of the device. In some implementations, the dimensions and design of the first arm 110 are based on the length and breadth of a typical human hand. For example, in some implementations, the first arm 110 is designed by considering the $95^{th}$ percentile hand breadth (i.e., width) of the female hand, or the $5^{th}$ percentile hand length of the female hand, or both. In some implementations, the 5th percentile female hand length is 6.26 inches and the $5^{th}$ percentile female hand breath is 2.72 inches. In some implementations, the $95^{th}$ percentile female hand length is 7.44 inches and the $95^{th}$ percentile female hand breath is 3.27 inches. Application of the $95^{th}$ percentile hand breath in designing the first arm 110 may allow a user to keep his or her hand away from hot sections of the drying device 100 during operation of the device. However, in other implementations, different percentiles of hand breath or hand length, and/or the male hand dimensions, may be taken into consideration in designing the first arm 110.

Figure 3A:
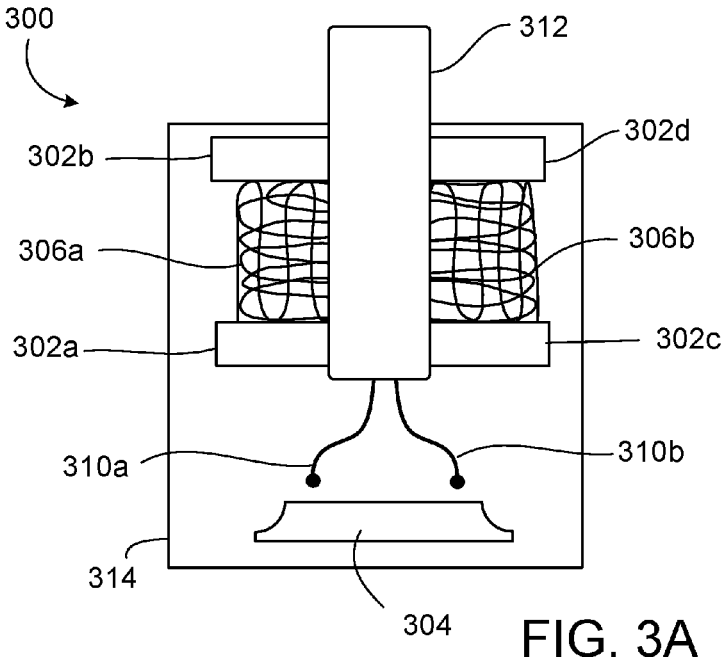
FIGS. 3A, 3B and 3C illustrate an example of a motor for use with a drying device.
Figure 3B:
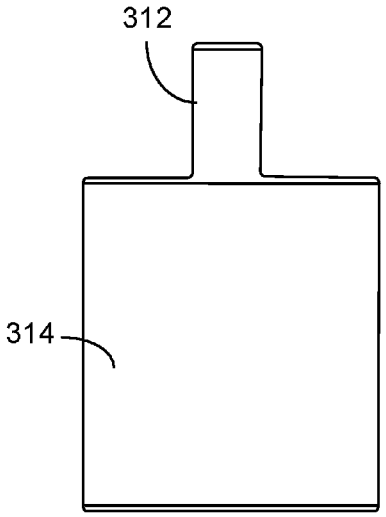
Figure 3C:
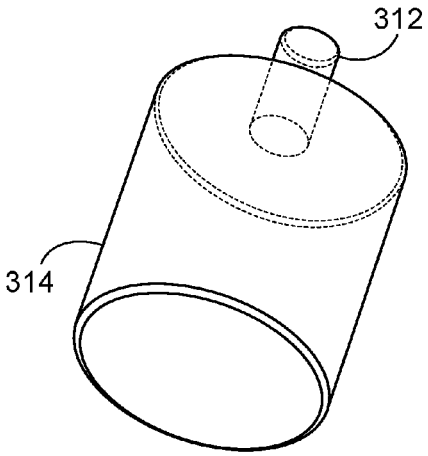

FIGS. 3A, 3B and 3C illustrate an example of a motor 300 for use with a drying device. In some implementations, the motor 300 is similar to the motor 112 included in the drying device 100. Accordingly, the following sections describe the motor 300 with reference to the drying device 100. However, the motor 300 also may be included in other drying devices, or systems in other implementations.

As shown in FIG. 3A, the motor 300 includes magnets 302*a*, 302*b*, 302*c*, and 302*d*; a battery 304; coils 306*a* and 306*b*; leads 310*a* and 310*b*; and a shaft 312. The components of the motor 300 are enclosed by a casing 314.

The battery 304 provides the energy to operate the motor. The battery 304 may be a lithium ion battery, or a nickel metal hydride battery, or a battery made from some other suitable material. In some implementations, the battery 304 may be a rechargeable battery. The battery 304 may be charged by coupling the battery, e.g., via electrical connections, to an electrical power source, which may be external to the drying device. In some implementations, the battery 304 may be positioned outside the casing 314.

Although the example illustrated in FIG. 3A shows four magnets 302*a*, 302*b*, 302*c* and 302*d*, and two coils 306*a* and 306*b*, in some implementations the number of magnets, or the number of coils, or both, may be different. In some implementations, one or more of the magnets 302*a*, 302*b*, 302*c* and 302*d* may be ceramic magnets. In some implementations, one or more of the coils 306*a* and 306*b* may be copper coils. When energy is applied to the motor 300, the magnets and the coils may be operated to generate a force field for rotating the shaft 312.

The leads 310*a* and 310*b* are coupled to the shaft 312. The leads are configured to electrically couple the shaft 312 to the battery 304. Although FIG. 3A shows two leads 310*a* and 310*b*, in some implementations a different number of leads may be present.

The shaft (i.e., rod) 312 is coupled to a fan included in the drying device, e.g., the fan 118 described previously. When the motor 300 is operational, the shaft 312 spins to operate the fan. The spinning of the shaft 312 is controlled by the force field generated using the magnets 302*a*, 302*b*, 302*c* and 302*d*, and the coils 306*a* and 306*b*.

The casing 314 is composed of some suitable material. In some implementations, the casing 314 is made of a suitable lightweight metal. The casing 314 is configured to enclose the components of the motor 300. FIGS. 3B and 3C illustrate alternate views of the motor 300, as seen from outside the casing 314. As shown, a portion of the shaft 312 protrudes outside the casing 314.

In some implementations, the motor 300 is smaller, but more powerful, than typical motors used in traditional hair dryers. The increased power of the motor 300 enables placement of the motor at increased distance from the inflow and/or outflow ends of the first arm 110.

Figure 4A:
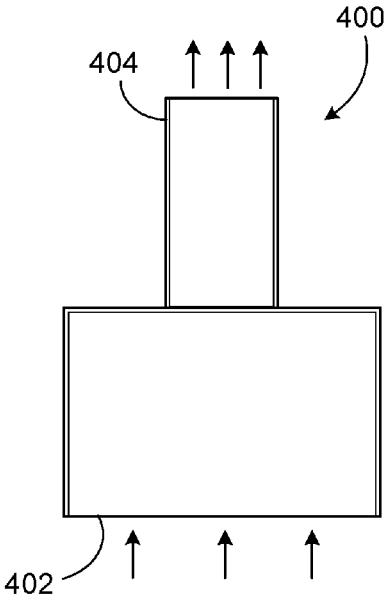
FIGS. 4A and 4B illustrate two views of an example of an airflow tube for use with a drying device.
Figure 4B:
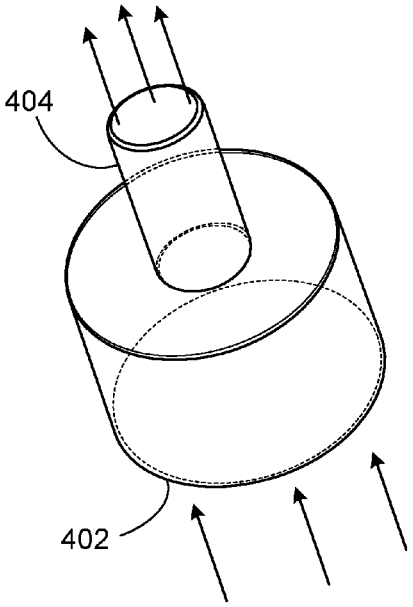

FIGS. 4A and 4B illustrate two views of an example of an airflow tube 400 for use with a drying device. In some implementations, the airflow tube 400 is similar to the airflow tube 116 included in the drying device 100. Accordingly, the following sections describe the airflow tube 400 with reference to the drying device 100. However, the airflow tube 400 also may be included in other drying devices or systems in other implementations.

The airflow tube 400 includes an inflow end 402 and an outflow end 404. Air is blown into the airflow tube 400 through the inflow end 402, and the air exits the airflow tube through the outflow end 404, which is then funneled into the rotatable coupler, e.g., rotatable coupler 120.

The airflow tube 400 is shaped such that the inflow end 402 is wider than the outflow end 404. In some implementations, the shape of the airflow tube 400 may be similar to that of a funnel. As described previously, such a shape of the airflow tube 400 restricts the air generated from the fan within the first arm 110 and thereby adds pressure and speed to the air as it exits the first arm 110. This is useful when the motor, e.g., motor 112, is of smaller size, or the motor is located farther away from the rotatable coupler, or both.

Figure 5:
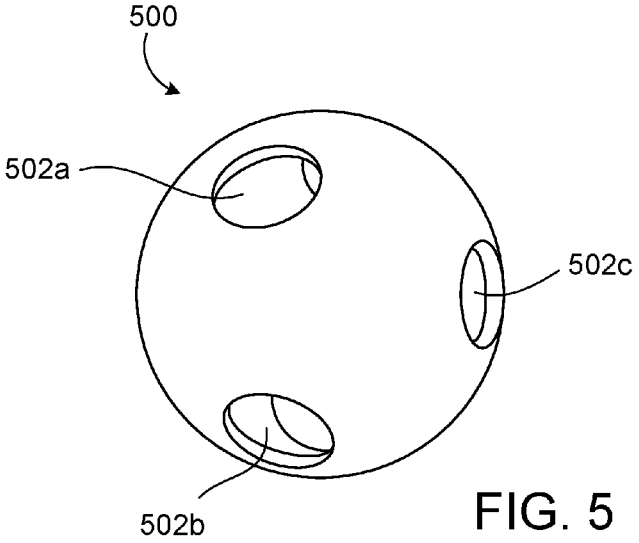
FIG. 5 illustrates an example of an air pocket for use with a drying device.

FIG. 5 illustrates an example of an air pocket 500 for use with a drying device. In some implementations, the air pocket 500 is similar to the air pocket 122 included in the drying device 100. Accordingly, the following sections describe the air pocket 500 with reference to the drying device 100. However, the air pocket 500 also may be included in other drying devices, or systems in other implementations.

As shown, the air pocket 500 includes a solid spherical surface enclosing a central cavity and openings or holes 502*a*, 502*b* and 502*c* on the spherical surface. As described previously, in some implementations the air pocket 500 is coupled to the first arm 110 of the drying device such that one opening of the air pocket, e.g., 502*a*, is aligned with the opening at the outflow end 113 of the first arm. In some implementations, the outflow end opening of the first arm 110 may correspond to the opening at the outflow end 404 of the airflow tube 400 included in the first arm. This configuration enables the air that is moved by the fan through the first arm 110 to enter the air pocket 500 through the aligned openings. The air inside the air pocket 500 exits through one of the other openings, e.g., 502*b* or 502*c*, when that particular opening is aligned with a first opening of the pocket frame, as described previously.

In some implementations, one or more openings of the air pocket 500 may have dimensions or sizes (e.g., diameter of the opening) that are different from that of other openings of the air pocket 500. For example, opening 502*a* may have a size that is different from the size of the opening 502*b*. The size of 502*c* also may be different from that of 502*a*, or 502*b*, or both. Additionally or alternatively, in some implementations one or more openings of the air pocket 500 may have shapes that are different from that of other openings of the air pocket 500. For example, opening 502*a* may have a shape that is different from the shape of the opening 502*b*. The shape of 502*c* also may be different from that of 502*a*, or 502*b*, or both. In some implementations, the opening of the air pocket, e.g., 502*a*, that is aligned with the opening at the outflow end 113 of the first arm is of a different size and/or shape than the other openings, e.g., 502*b* and 502*c*, of the air pocket, all of which may be of the same size and/or shape. For example, the opening 502*a* may be larger than the openings 502*b* or 502*c*.

In some implementations, variations in the sizes and/or the shapes of the openings 502*a*, 502*b* and 502*c* enable variations in the volume of air that is blown into the second arm 130 (and accordingly expelled to the external environment) through the aligned openings of the air pocket, the pocket frame and the second arm. For example, the volume of air that is blown into the second arm 130 may be less when the aligned opening of the air pocket 500 is smaller in size compared to the case when the aligned opening of the air pocket is larger in size. Additionally or alternatively, the volume of air that is blown into the second arm 130 may be different when the aligned opening of the air pocket 500 is of a first shape (e.g., circular) compared to the case when the aligned opening of the air pocket is of a second shape (e.g., elliptical).

In some implementations, variations in the sizes and/or the shapes of the openings 502*a*, 502*b* and 502*c* enable variations in the pressure or speed of air that is blown into the second arm 130 (and accordingly expelled to the external environment) through the aligned openings of the air pocket, the pocket frame and the second arm. For example, the pressure or speed of air that is blown into the second arm 130 may be more when the aligned opening of the air pocket 500 is smaller in size compared to the case when the aligned opening of the air pocket is larger in size. Additionally or alternatively, the pressure or speed of air that is blown into the second arm 130 may be different when the aligned opening of the air pocket 500 is of a first shape (e.g., circular) compared to the case when the aligned opening of the air pocket is of a second shape (e.g., elliptical).

Figure 6A:
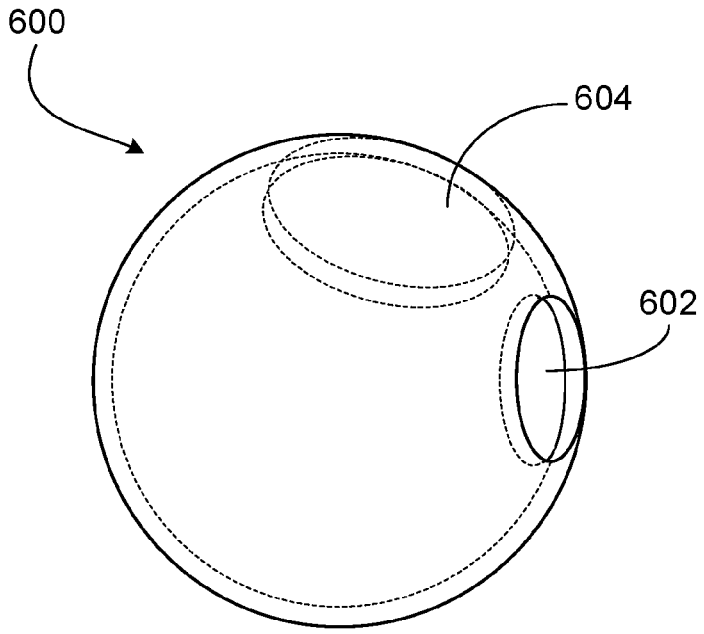
FIGS. 6A and 6B illustrate two views of an example of a pocket frame for use with a drying device.
Figure 6B:
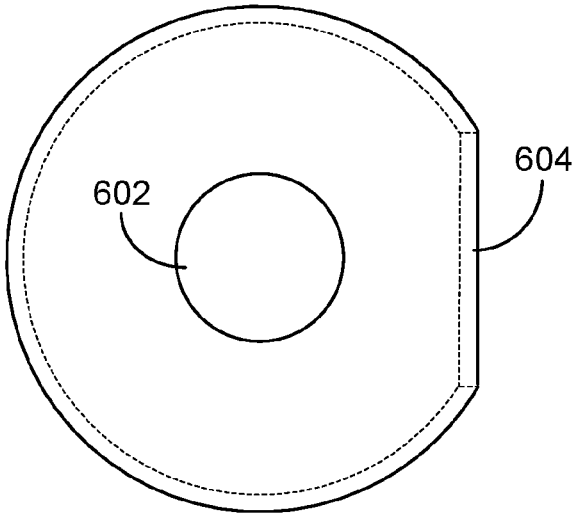

FIGS. 6A and 6B illustrate two views of an example of a pocket frame 600 for use with a drying device. In some implementations, the pocket frame 600 is similar to the pocket frame 124 included in the drying device 100. Accordingly, the following sections describe the pocket frame 600 with reference to the drying device 100. However, the pocket frame 600 also may be included in other drying devices, or systems in other implementations.

As shown, the pocket frame 600 includes a solid spherical surface enclosing central cavity, a first opening 602 and a second opening 604 on the spherical surface. The second opening 604 of the pocket frame is configured to provide space for the first arm 110 to couple to the air pocket (e.g., air pocket 122 or 500) that is enclosed within the pocket frame 600, as described previously. In some implementations, the pocket frame 600 is coupled to second first arm 130 of the drying device such that the first opening 602 is aligned with the opening at the inflow end 131 of the second arm.

In some implementations, the first opening 602 and the second opening 604 of the pocket frame 600 are of different sizes and/or shapes. The dimensions (e.g., size and/or shape) of the second opening 604 may be configured to provide sufficient space for the first arm 110 to fit through the opening 604 to couple to the air pocket. For example, the second opening 604 may have a larger diameter than the first opening 602. However, in some implementations the second opening 604 may have a smaller diameter than the first opening 602.

As noted previously, the air pocket and the pocket frame form an inner and outer sphere system, with the air pocket being the inner sphere enclosed by the pocket frame forming the outer sphere. In some implementations, the dimensions of the first opening 602, or the second opening 604, or both, are configured such that the air pocket cannot be removed from the pocket frame enclosure through either the first opening 602 or the second opening 604. This may be the case, for example, when the diameter of the air pocket is greater than the diameter of either the first opening 602 or the second opening 604.

The pocket frame is able to rotate about one or more axes, thereby allowing multiple orientations of the pocket frame and the second arm (that is coupled to the pocket frame) with respect to the first arm (that is coupled to the air pocket). When the drying device is operated, the user maneuvers the device such that the first opening 602 of the pocket frame 600 is aligned with one of the additional openings of the air pocket, e.g., 502*b* or 502*c*. This configuration enables the air that is moved by the fan through the first arm 110 into the air pocket to exit through the aligned openings of the air pocket and pocket frame into the second arm and then out to the external environment through the opening at the outflow end 133 of the second arm, as described previously.

In some implementations, when the first opening 602 of the pocket frame 600 is thus aligned with one of the additional openings of the air pocket, e.g., 502*b* or 502*c*, the pocket frame 600 locks in place with respect to the air pocket 500, such that the alignment of the openings is not easily disturbed when the user maneuvers the drying device during use. In such implementations, the pocket frame 600 may be released from the present alignment (e.g., for reorientation) by applying greater-than-normal pressure to rotate the pocket frame, or by selecting a control panel option (e.g., depressing a button) to release the alignment lock, or some other suitable option.

In some implementations, a sealant is used to close any gap in the second opening 604 surrounding the first arm 110 that is inserted through the second opening to couple to the air pocket. This may be the case, for example, when the inner surface of the pocket frame is not physically in contact with the outer surface of the air pocket, such that a space exists between the air pocket and the pocket frame. In this configuration, the sealant prevents air, as it is blown from the air pocket into the second arm through the aligned openings of the air pocket, the pocket frame and the second arm, from escaping to the external environment through the space between the air pocket and the pocket frame, and through any gap in the second opening 604.

Figure 7A:
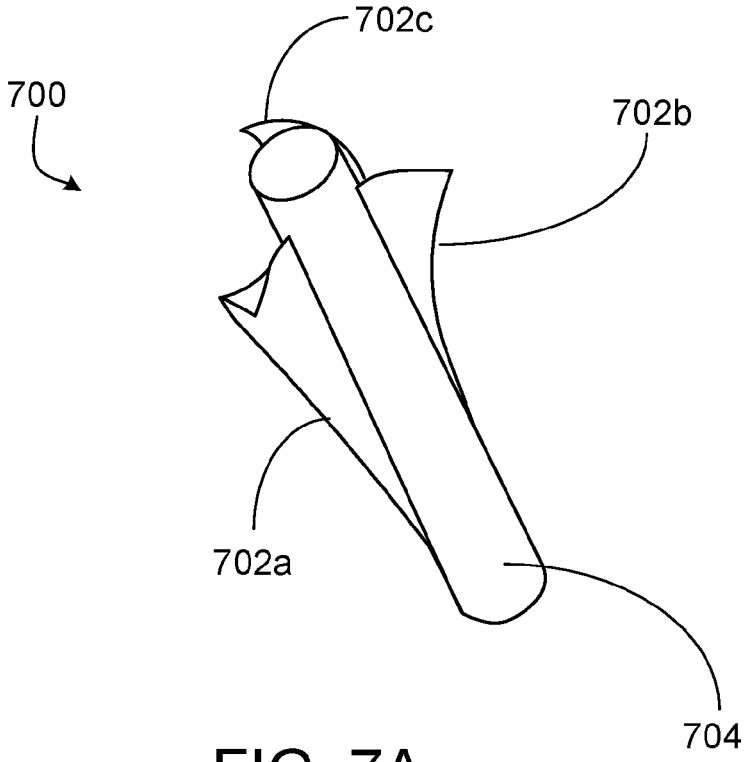
FIGS. 7A and 7B illustrate two views of an example of a fan for use with a drying device.
Figure 7B:
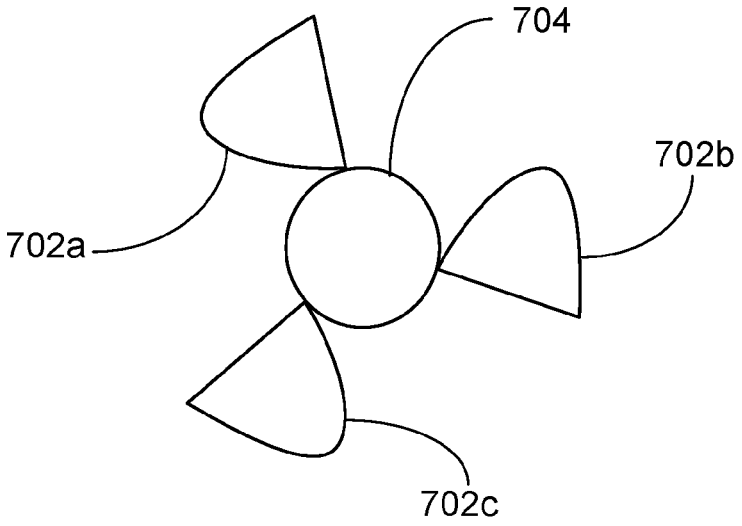

FIGS. 7A and 7B illustrate two views of an example of a fan 700 for use with a drying device. In some implementations, the fan 700 is similar to the fan 118 included in the drying device 100. Accordingly, the following sections describe the fan 700 with reference to the drying device 100. However, the fan 700 also may be included in other drying devices, or systems in other implementations.

The fan 700 includes blades 702*a*, 702*b* and 702*c*; and a central shaft 704. In some implementations, the shaft (i.e., rod) 704 is coupled to the motor included in the drying device, e.g., motor 112 or 300. For example, in some implementations the shaft 704 may be coupled to the shaft 312. In some implementations, the shaft 704 may be same as the shaft 312. When the motor is operated, the shaft 704 spins such that air is generated and moved by the blades

702*a*, 702*b*, and/or 702*c*. The air generated by the blades is moved through the first arm into the rotatable coupler, as described previously.

Figure 8B:
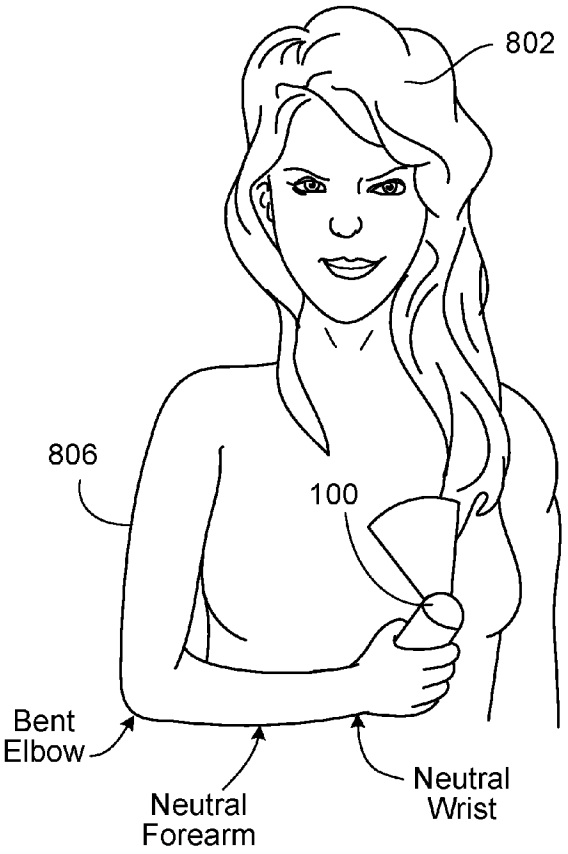
FIGS. 8A-8F illustrate example postures of a user while operating the drying device.
Figure 8A:
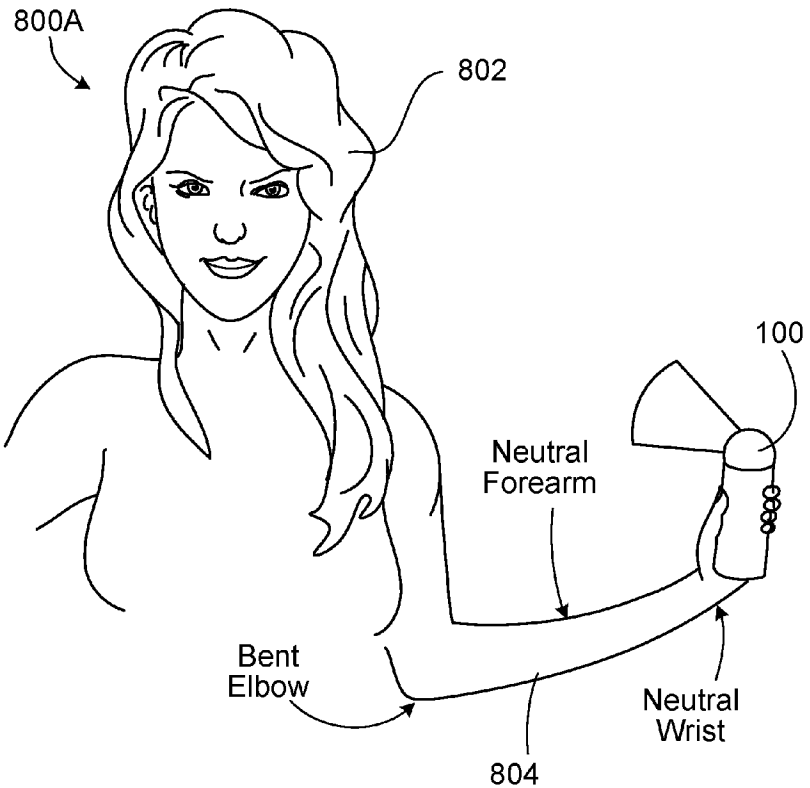

FIGS. 8A-8F illustrate example postures 800A, 800B, 800C and 800D of a user while operating the drying device 100. FIG. 8A shows a user with long hair 802 operating the drying device 100 using the left arm 804 in posture 800A, while FIG. 8B shows the same user operating the drying device 100 using the right arm 806 in posture 800A. As shown by FIGS. 8A and 8B, while in posture 800A, the user is able to operate the drying device 100 to dry his or her long hair 802 using a neutral wrist posture, irrespective of whether the left arm 804 or the right arm 806 is used. In posture 800A, the arm is bent at the elbow, but the forearm and the wrist remain in neutral positions. Accordingly, posture 800A may allow a user to dry his or her long hair in a manner that is comfortable to the user.

Figure 8C:
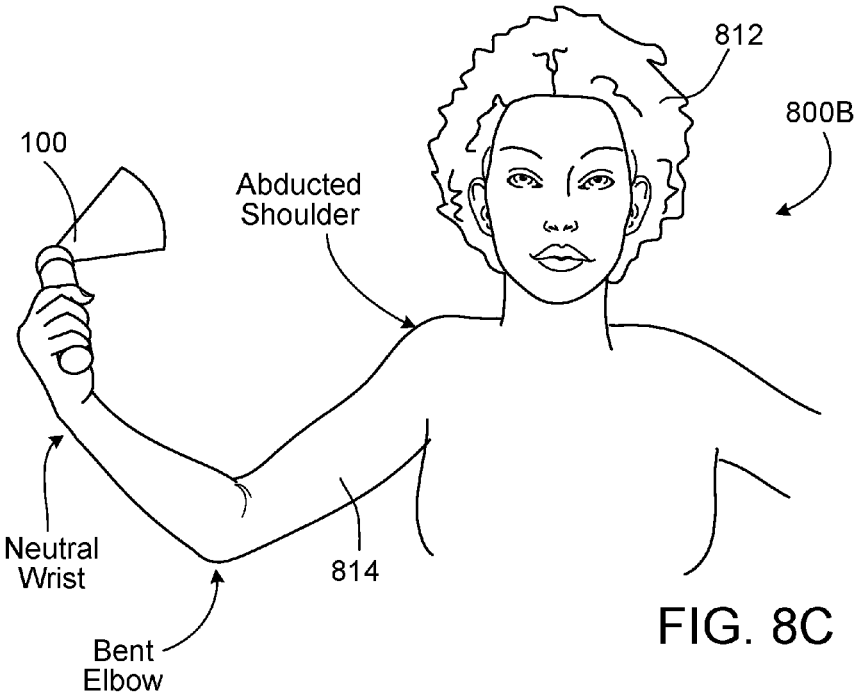
Figure 8D:
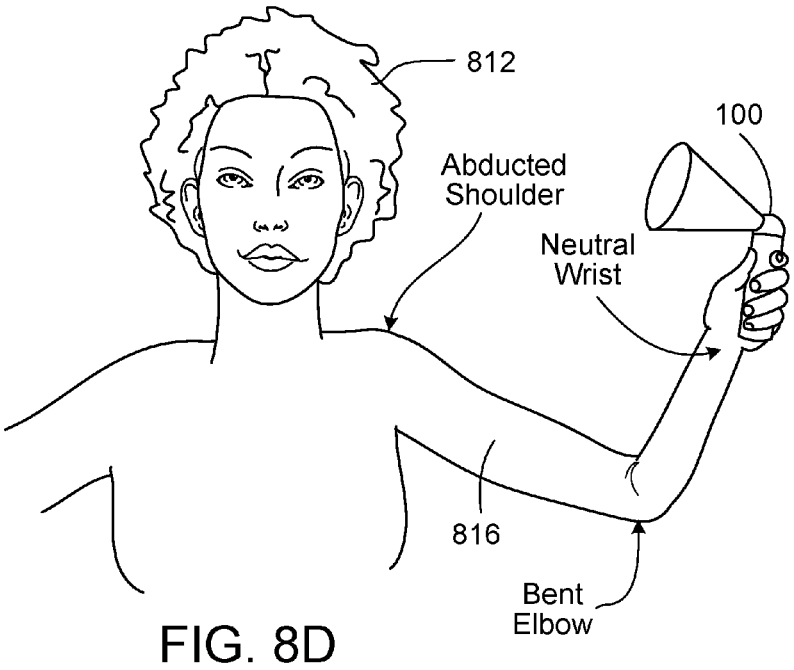

FIG. 8C shows a user with curly/short hair 812 operating the drying device 100 using the right arm 814 in posture 800B, while FIG. 8D shows the same user operating the drying device 100 using the left arm 816 in posture 800B. As shown by FIGS. 8C and 8D, while in posture 800B, the user is able to operate the drying device 100 to dry his or her curly (and/or short) hair 812 using a neutral wrist posture, irrespective of whether the right arm 814 or the left arm 816 is used. In posture 800B, while using either arm, the shoulder is abducted, the arm is bent at the elbow, but the wrist remains in a neutral position. Accordingly, posture 800B may allow a user to dry his or her curly/short hair in a manner that is comfortable to the user.

Figure 8E:
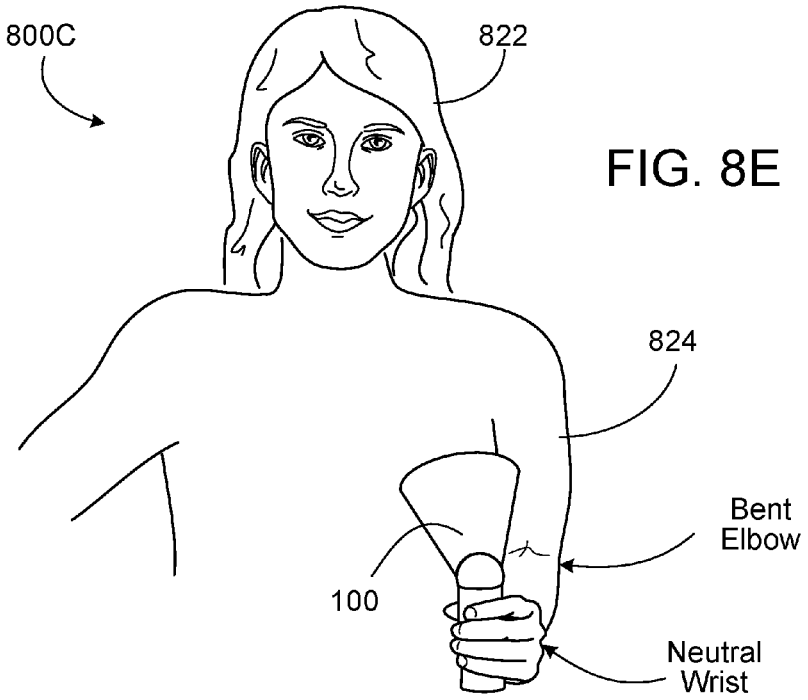
Figure 8F:
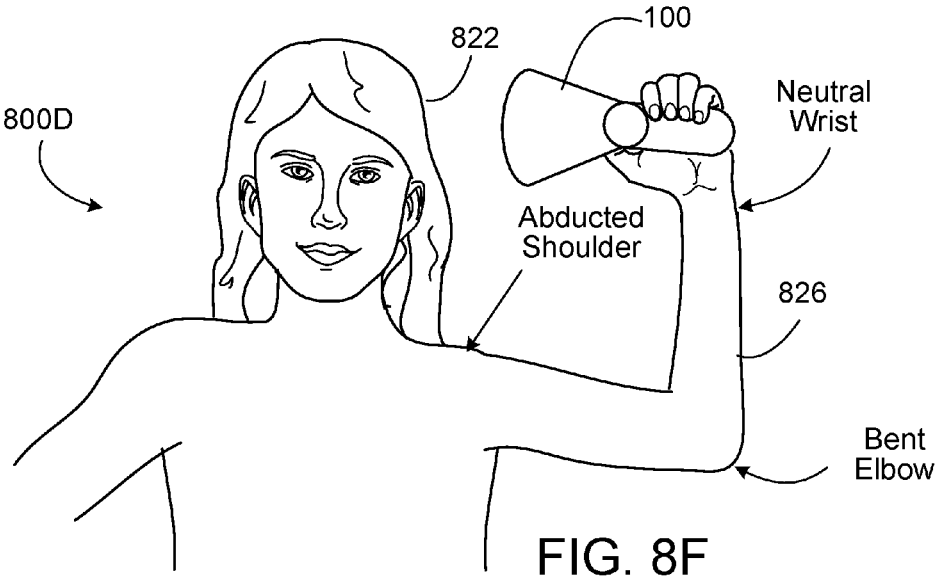

FIG. 8E shows a user with medium-length hair 822 operating the drying device 100 using the left arm 824 in posture 800C, while FIG. 8F shows the same user operating the drying device 100 using the right arm 826 in posture 800D. As shown by FIGS. 8E and 8F, while in posture 800C or 800D, the user is able to operate the drying device 100 to dry his or her medium-length hair 822 using a neutral wrist posture, irrespective of whether the left arm 824 or the right arm 826 is used. FIG. 8E indicates that while using left arm 824 in posture 800C, the arm is bent at the elbow, but the wrist remains in a neutral position. FIG. 8F indicates that while using right arm 826 in posture 800D, the shoulder is abducted, the arm is bent at the elbow, but the wrist remains in a neutral position. Accordingly, posture 800C or 800D may allow a user to dry his or her medium-length hair in a manner that is comfortable to the user.

FIGS. 8A-8F indicate that the same drying device 100 may be effectively applied to treat hair of different lengths and/or textures, while holding the drying device in a posture that is comfortable to the user. FIGS. 8A-8F further show that all the postures 800A, 800B, 800C and 800D exhibit neutral neck positions. This may further contribute to the user's comfort while operating the drying device 100.

The processing logic described above (also known as a computer program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code).

As indicated previously, the processing logic described in this document can be performed by one or more microcontrollers or programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. Computer readable media suitable for storing computer program instructions and data can include all forms of nonvolatile memory, media and memory devices, including by way of example semiconductor memory devices, e.g., EPROM, EEPROM, and flash memory devices; magnetic disks, e.g., internal hard disks or removable disks; and magneto optical disks. The processor and the memory can be supplemented by, or incorporated in, special purpose logic circuitry.

While this document may describe many specifics, these should not be construed as limitations on the scope of an invention that is claimed or of what may be claimed, but rather as descriptions of features specific to particular embodiments. Certain features that are described in this document in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination in some cases can be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Only a few examples and implementations are disclosed. Variations, modifications, and enhancements to the described examples and implementations and other implementations can be made based on what is disclosed.

What is claimed is:

1. A hair drying device comprising:

a fan;

a motor that is configured to operate the fan for moving air;

a heating coil that is configured to heat air moved based on operation of the fan;

a first arm that includes a first cavity enclosed by at least a wall of the first arm and is configured to move air through the first arm based on operation of the fan;

a second arm that includes a second cavity enclosed by at least a wall of the second arm and an outflow opening to an external environment, wherein the second arm is configured to:

receive air moved through the first arm;

heat received air using the heating coil; and expel heated air through the outflow opening of the second arm; and a rotatable coupler that includes a first spherical frame that is coupled to the first arm and a second spherical frame that envelops the first spherical frame and is coupled to the second arm, wherein the rotatable coupler is configured to:

permit rotation of the second arm relative to the first arm along multiple axes;

receive air from the first arm through an inflow opening associated with the rotatable coupler; and transfer received air to the second arm through an outflow opening associated with the rotatable coupler.

2. The device of claim 1, further comprising:

an airflow tube included in the first arm, the airflow tube configured to:

receive air moved by the fan through a first opening of the airflow tube; and increase at least one of air speed or air pressure by outputting air through a restricted second opening of the airflow tube that is smaller than the first opening of the airflow tube.

3. The device of claim 2, further comprising:

a second fan included in the rotatable coupler, the second fan configured to move air, received from the first arm via the second opening of the airflow tube, to the second arm with increased force.

4. The device of claim 2, wherein the inflow opening of the rotatable coupler is aligned with the second opening of the airflow tube, the alignment configured to enable air outputted by the airflow tube to be received in the rotatable coupler for transferring to the second arm.

5. The device of claim 1, wherein:

the first spherical frame includes the inflow opening associated with the rotatable coupler that is configured to enable alignment with an outflow opening of the first arm to receive air from the first arm into the first spherical frame, the first spherical frame further including one or more additional openings; and the second spherical frame includes the outflow opening associated with the rotatable coupler that is configured to enable alignment with an inflow opening of the second arm to transfer air received from the first arm to the second arm, the second spherical frame further including a second opening that is configured to enable alignment with one of the additional openings of the first spherical frame to receive air from the first spherical frame.

6. The device of claim 5, wherein at least one of the first spherical frame or the second spherical frame is maneuverable with respect to each other to enable alignment of the second opening of the second spherical frame with one of the additional openings of the first spherical frame.

7. The device of claim 6, wherein remaining openings of the first spherical frame are blocked when the second opening of the second spherical frame is aligned with one of the additional openings of the first spherical frame.

8. The device of claim 1, further comprising:

a processing module; and a temperature sensor that is configured to:

determine a temperature of heated air; and communicate the temperature of heated air to the processing module.

9. The device of claim 8, wherein the processing module is configured to:

compare the temperature of heated air to a preconfigured threshold; and execute instructions to automatically reduce amount of heat generated by the heating coil when the temperature of heated air exceeds the preconfigured threshold.

10. The device of claim 8, wherein the processing module is configured to execute instructions to automatically switch operation of the device from generating heated air to generating unheated air.

11. The device of claim 8, wherein the temperature sensor is affixed to a wall of the second arm and is configured to determine a temperature of heated air that is expelled through the opening of the second arm.

12. The device of claim 1, further comprising a control panel that is configured to:

present, using a user interface, options to enable a user to adjust one or more settings associated with operation of the device.

13. The device of claim 12, wherein the one or more settings include at least one of air pressure, temperature of heated air, or operational time of the device.

14. The device of claim 12, further comprising a display associated with the control panel, wherein the control panel is configured to present the user interface as a graphical user interface shown on the display.

15. The device of claim 1, wherein the second arm is configured to be replaceable with a different second arm having a different shape.

16. The device of claim 1, wherein at least one of the motor, the fan, or the heating coil is positioned within the first cavity of the first arm.

17. The device of claim 1, wherein at least one of the motor, the fan, or the heating coil is positioned within the second cavity of the second arm.

18. The device of claim 1, wherein at least one of the motor, the fan, or the heating coil is positioned within the rotatable coupler.

19. The device of claim 1, wherein the motor includes one or more of ceramic magnets, copper coil, a battery, or a rod with leads attached to the battery, and wherein the motor is covered by a casing.

20. A hair drying device comprising:

a fan;

a first arm that includes a first cavity enclosed by at least one wall of the first arm, and a motor positioned within the first cavity that is configured to operate the fan to move air through the first arm;

a second arm that includes an outflow opening to an external environment and a heating coil positioned within a second cavity enclosed by at least one wall of the second arm, wherein the second arm is configured to:

receive air moved through the first arm;

heat received air using the heating coil; and expel heated air through the outflow opening; and a rotatable coupler that includes a first frame that is coupled to the first arm and a second frame that envelops the first frame and is coupled to the second arm, wherein the rotatable coupler is configured to:

maneuver the second arm relative to the first arm along multiple axes;

receive air from the first arm through an inflow opening associated with the rotatable coupler; and transfer received air to the second arm through an outflow opening associated with the coupler.

21. The device of claim 20, wherein:

the first frame includes the inflow opening associated with the rotatable coupler that is configured to enable alignment with an outflow opening of the first arm to receive air from the first arm into the first frame, the first frame further including one or more additional openings; and the second frame includes the outflow opening associated with the rotatable coupler that is configured to enable alignment with an inflow opening of the second arm to transfer air received from the first arm to the second arm, the second frame further including a second opening that is configured to enable alignment with one of the additional openings of the first frame to receive air from the first frame.

22. The device of claim 21, wherein at least one of the first frame or the second frame is configured to be maneuverable with respect to each other to enable alignment of the second opening of the second frame with one of the additional openings of the first frame.

23. The device of claim 21, further comprising:

an airflow tube included in the first arm, the airflow tube configured to:

receive air moved by the fan through a first opening of the airflow tube; and increase at least one of air speed or air pressure by outputting air through a restricted second opening of the airflow tube that is smaller than the first opening of the airflow tube.

24. The device of claim 21, further comprising:

a processing module; and a temperature sensor that is configured to:

determine a temperature of heated air; and communicate the temperature of heated air to the processing module.

25. The device of claim 24, wherein the processing module is configured to:

compare the temperature of heated air to a preconfigured threshold; and execute instructions to automatically reduce amount of heat generated by the heating coil when the temperature of heated air exceeds the preconfigured threshold.

26. The device of claim 21, further comprising a control panel that is configured to:

present, using a user interface, options to enable a user to adjust one or more settings associated with operation of the device.

* * * * *